US005619102A

United States Patent [19]

Scholler

[11] Patent Number: 5,619,102

[45] Date of Patent: Apr. 8, 1997

[54] ELECTRIC LAMP

[75] Inventor: Klaus Scholler, Nideggen, Germany

[73] Assignee: U.S. Philips Corporation, New York, N.Y.

[21] Appl. No.: 554,119

[22] Filed: Nov. 6, 1995

[30] Foreign Application Priority Data

Nov. 10, 1994 [EP] European Pat. Off. ..... 94203276

[51] Int. Cl.[6] ..... H01J 17/16; H01J 61/30; H01J 61/35

[52] U.S. Cl. ..... 313/635; 313/636; 313/634

[58] Field of Search ..... 313/478, 489, 313/630, 634, 635, 636, 631–633; 501/32, 53, 54

[56] References Cited

U.S. PATENT DOCUMENTS 4,061,946 12/1977 Schreurs ..... 313/489 X

FOREIGN PATENT DOCUMENTS

0354620A1 2/1990 European Pat. Off. ..... H01K 1/32
942013186 11/1994 European Pat. Off. .
1422491 1/1974 United Kingdom ..... H05K 5/00

*Primary Examiner*—Sandra L. O'Shea
*Assistant Examiner*—Mack Haynes
*Attorney, Agent, or Firm*—Walter M. Egbert, III

[57] ABSTRACT

The electric lamp has a quartz glass lamp vessel (10) in which an electric element (3, 4) is accommodated. The lamp vessel locally has a light-absorbing, non reflective coating (11, 12). The coating mainly consists of 2 to 10% by weight of glass which is free of lead oxide and has a softening point between 600° and 700° C. Iron 50 to 60% by weight, primarily in metallic form, and manganese oxide, 30 to 55% by weight, are dispersed therein.

5 Claims, 1 Drawing Sheet

ELECTRIC LAMP

Figure 1:
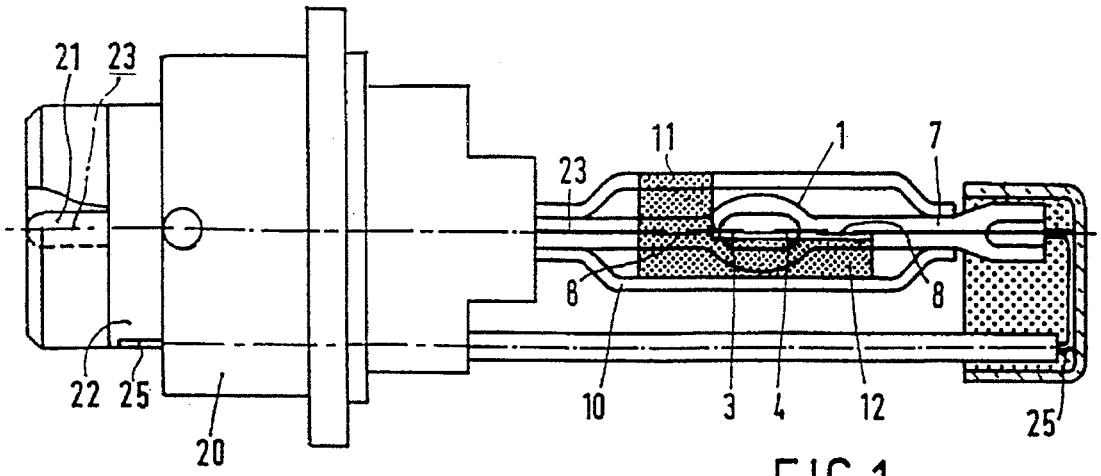

The invention relates to an electric lamp provided with a lamp vessel which is made of glass with at least 96% $SiO_2$, by weight and in which an electric element is arranged to which current conductors are connected which issue from the lamp vessel to the exterior, which lamp vessel is locally coated with a light-absorbing coating which comprises iron oxide and manganese oxide.

An electric halogen incandescent lamp of this kind is known from EP-A 0 354 620.

Besides iron oxide and manganese oxide, the known coating also comprises titanium oxide and magnetite, $Fe_3O_4$, as pigments, and ethyl silicate as an adhesive. The known coating is obtained from a suspension which in addition comprises iron, sodium metaphosphate, monobutylglycol ether, glycol, and ethanol. The suspension is not only of a complicated composition, but also has a limited shelf life.

The known coating has the disadvantage that it can be comparatively easily knocked off the lamp vessel. The iron in the suspension is converted into iron oxide when the coating is burned in.

An electric lamp is known from GB 1 422 491 which has a coating of approximately one-third by weight of glass frit comprising more than 70% by weight lead oxide, and in addition silicon oxide and boron oxide, and the oxides of iron, cobalt and manganese as pigments. It was found that this coating does adhere permanently to a lamp vessel made of hard-glass, but that it quickly starts flaking off glass with an $SiO_2$ content of at least 96% by weight, such as quartz glass, which has a much lower coefficient of thermal expansion than hard-glass. Another disadvantage is that this coating comprises substances which are harmful to the environment: cobalt oxide in the pigment, and also lead oxide in the glass frit. This coating has the further disadvantage that it transmits comparatively much light. This disadvantage becomes more important in proportion as the luminance of the light source is higher, as is the case for example, in a high-pressure discharge lamp.

Such a high-pressure discharge lamp suitable for use as a vehicle headlamp is described in EP 94 201 318.6 (PHN 14.852) of earlier date. The electric element therein is a pair of electrodes arranged in an ionizable medium in an inner envelope which is sealed in a vacuumtight manner. The light-absorbing coating of this lamp is obtained, for example, from a suspension comprising silicon powder and iron powder.

It is an object of the invention to provide an electric lamp of the kind mentioned in the opening paragraph which is provided with a durable light-absorbing coating which has a comparatively high light absorption and impermeability to light.

According to the invention, this object is achieved in that the coating is substantially formed by 2 to 10% glass by weight with dispersed therein 30 to 65, for example 50 to 60% iron by weight, mostly in metallic, and partly in oxidic form, and 30 to 65, for example 30 to 45% manganese oxide by weight, the glass being substantially free from lead oxide and having a softening point between 600° and 700° C.

Iron, mainly present as a metal, is a main component in the lamp according to the invention. The glass of the coating renders it possible to burn in the coating on the lamp vessel in a heat treatment of short duration, for example a few seconds, at a comparatively low temperature, for example 700° to 800° C. or a few tens of seconds at 600° to 650° C. It can be prevented thereby that iron is largely converted into an oxidic form, and a high optical density and a high absorption power remain intact. This low oxidation rate, in general at most a few mole %, is achieved in spite of the low glass content of the coating, and the high density and high absorption are obtained thanks to this low glass content. The low glass content also provides a high resistance of the coating to flaking-off, also because the coating can be comparatively thin. The coating has the additional advantage that it reflects little or substantially no light, which may be present as parasitic light in a light beam formed by an optical system, for example a reflector and a lens.

In a favourable embodiment, the glass of the coating is zincborosilicate glass, for example glass containing 12.3% silicon dioxide by weight, 22.7% boron oxide by weight, 59.7% zinc oxide by weight, 5.2% magnesium oxide by weight, and 0.1% calcium oxide by weight. This glass has a softening temperature of 650° C. The glass of the coating may alternatively be barium-calcium borate glass, for example 17.2% boron oxide by weight, 10.3% calcium oxide by weight, 51.3% strontium oxide and barium oxide by weight, wherein strontium oxide <1.5% by weight, 5.1% magnesium oxide by weight, 8.8% aluminium oxide by weight, 5.6% silicon oxide by weight, 1.5% zirconium oxide by weight, and 0.2% potassium oxide by weight. This glass has a softening temperature of 655° C.

The coating may be readily obtained from a suspension of a mixture of glass powder, iron oxide and manganese oxide powders, for example in a mixture of glycerol and ethanol. After the suspension has been applied and dried, the residue is fixed by heating up to close to or to above the softening point of the glass component, i.e. the temperature at which the glass has a viscosity of $10^{7.6}$ dPa.s.

Figure 2:
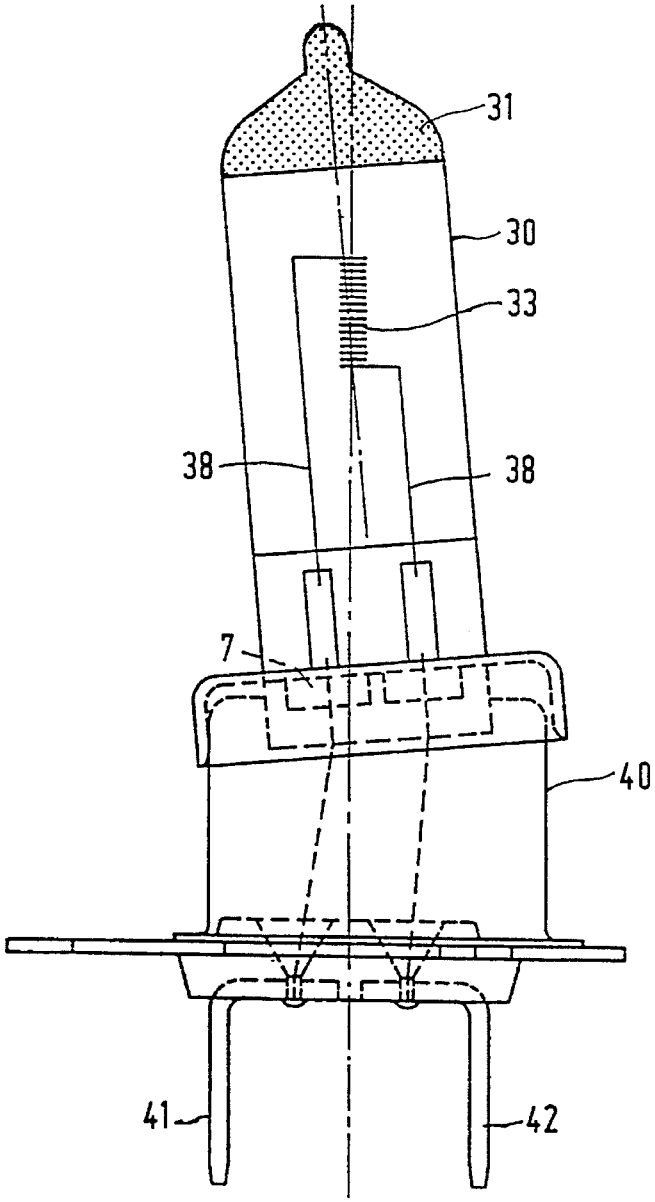

Embodiments of the electric lamp according to the invention are shown in the drawing, in which FIG. 1 shows a discharge lamp in side elevation, partly in cross-section; and FIG. 2 shows an incandescent lamp in side elevation.

In FIG. 1, the high-pressure discharge lamp has a quartz glass lamp vessel 10 in which an electric element is arranged. The electric element comprises electrodes 3, 4 in an inner quartz glass envelope 1 containing an ionizable filling. The filling comprises, for example, mercury, a mixture of metal halide such as sodium iodide and scandium iodide, and a rare gas such as, for example, xenon, for example with a filling pressure of several bar. Current conductors 8, 23; 8, 25 are connected to the electrodes and issue from the lamp vessel to the exterior. The lamp has a lamp cap 20 fitted with contacts 21, 22. The lamp vessel is locally covered with a light-absorbing coating 11, 12 which comprises iron oxide and manganese oxide.

The coating substantially contains 2 to 10% glass by weight with dispersed therein 30 to 65, for example 50 to 60% iron by weight, mainly in metallic and partly in oxidic form, and 30 to 65, for example 30 to 45% manganese oxide by weight, the glass being substantially free from lead oxide and having a softening point between 600° and 700° C.

In the embodiment drawn, the glass of the coating is zincborosilicate glass. The glass comprises 12.3% silicon dioxide by weight, 22.7% boron oxide by weight, 59.7% zinc oxide by weight, 5.2% magnesium oxide by weight, and 0.1% calcium oxide by weight.

The coating was obtained from a suspension of 35 to 45, for example 40% iron powder by weight, 20 to 35, for example 30% manganese dioxide powder by weight, and 2 to 6, for example 5% glass powder by weight in 1 to 3, for example 2% glycerine by weight, and 15 to 38, for example 23% ethanol by weight. The coating substantially does not transmit light, substantially does not reflect light, and remains adhered to the lamp vessel during its entire life.

In a modification, the glass of the coating is barium-calcium borate glass, for example glass comprising 17.2% boron oxide by weight, 10.3% calcium oxide by weight, 51.3% strontium oxide and barium oxide by weight, wherein strontium oxide <1.5% by weight, 5.1% magnesium oxide by weight, 8.8% aluminium oxide by weight, 5.6% silicon oxide by weight, 1.5% zirconium oxide by weight, and 0.2% potassium oxide by weight.

In FIG. 2, the electric lamp has a quartz glass lamp vessel 30 with an incandescent body 33 therein, in an inert gas comprising a halogen in the Figure. The incandescent body is connected to current conductors 38 which issue from the lamp vessel to the exterior and are connected to respective contacts 41, 42 of a lamp cap fastened to the lamp vessel. The lamp vessel locally has a light-absorbing coating of the barium-calcium borate glass mentioned above with iron dispersed therein, this iron being predominantly in metallic form, i.e. 99 mole %, and manganese dioxide.

I claim:

1. An electric lamp provided with a lamp vessel (10) which is made of glass with at least 96% $SiO_2$ by weight and in which an electric element (3, 4) is arranged to which current conductors are connected which issue from the lamp vessel to the exterior, which lamp vessel is locally coated with a light-absorbing coating (11, 12) which comprises iron oxide and manganese oxide, characterized in that the coating (11, 12) is substantially formed by 2 to 10% glass by weight with dispersed therein 30 to 65% iron by weight, mostly in metallic, and partly in oxidic form, and 30 to 65% manganese oxide by weight, the glass being substantially free from lead oxide and having a softening point between 600° and 700° C.

2. An electric lamp as claimed in claim 1, characterized in that the glass of the coating (11, 12) is zincborosilicate glass.

3. An electric lamp as claimed in claim 2, characterized in that the glass comprises 12.3% silicon dioxide by weight, 22.7% boron oxide by weight, 59.7% zinc oxide by weight, 5.2% magnesium oxide by weight, and 0.1% calcium oxide by weight.

4. An electric lamp as claimed in claim 1, characterized in that the glass of the coating (31) is barium-calcium borate glass.

5. An electric lamp as claimed in claim 4, characterized in that the glass comprises 17.2% boron oxide by weight, 10.3% calcium oxide by weight, 51.3% strontium oxide and barium oxide by weight, wherein strontium oxide <1.5% by weight, 5.1% magnesium oxide by weight, 8.8% aluminium oxide by weight, 5.6% silicon oxide by weight, 1.5% zirconium oxide by weight, and 0.2% potassium oxide by weight.

* * * * *